US005367728A

United States Patent [19]

Chang

[11] Patent Number: 5,367,728

[45] Date of Patent: Nov. 29, 1994

[54] ADJUSTABLE VENTILATION MATTRESS

[76] Inventor: Ching-Lung Chang, No. 248, Dalin Rd., Daya Shiang, Taichung Hsien,

[21] Appl. No.: 51,352

[22] Filed: Apr. 23, 1993

[51] Int. Cl.[5] ..... A47C 27/08

[52] U.S. Cl. ..... 5/453; 5/455; 5/464; 5/615

[58] Field of Search ..... 5/453, 455, 469, 615, 5/903

[56] References Cited

U.S. PATENT DOCUMENTS

| | | | |
|---|---|---|---|
| 1,772,310 | 8/1930 | Hart | 5/615 |
| 3,377,103 | 4/1968 | Borton | 5/469 |
| 3,477,071 | 11/1969 | Emerson | 5/453 |
| 3,681,797 | 8/1972 | Messner | 5/469 |
| 3,736,604 | 6/1973 | Carson | 5/455 |
| 4,008,098 | 2/1977 | Thomas | 5/469 |
| 4,941,221 | 7/1990 | Kanzler | 5/903 |
| 5,121,512 | 6/1992 | Kaufmann | 5/453 |

*Primary Examiner*—Flemming Saether

*Attorney, Agent, or Firm*—Morton J. Rosenberg; David I. Klein

[57] ABSTRACT

An adjustable ventilation mattress including an inflatable upper filling layer consisted of rows of inflatable plastic tubes arranged in the longitudinal direction, an inflatable lower filling layer consisted of rows of inflatable plastic tubes arranged in the transverse direction below the inflatable upper filling layer, an air permeable covering covered over the inflatable upper and lower filling layers, and a controller controlled to inflate or selectively inflate the inflatable plastic tubes of the inflatable upper filling layer and/or the inflatable lower filling layer according to a predetermined setting for changing the configuration of the mattress.

1 Claim, 4 Drawing Sheets

ADJUSTABLE VENTILATION MATTRESS

BACKGROUND OF THE INVENTION

The present invention relates to mattresses and more specifically to an adjustable ventilation mattress which can be arranged into any of a variety of forms by for different purposes.

The mattress of a normal bed is not adjustable on its configuration once it was made. The beds for patients are commonly made foldable. A foldable bed can help the patient to sit comfortably, however, it can not help the patient to turn the body over.

SUMMARY OF THE INVENTION

The principal object of the present invention is to provide an adjustable ventilation mattress which is comprised of rows of inflatable plastic tubes arranged in the longitudinal direction and supported above rows of inflatable plastic tubes being arranged in the transverse direction, an air permeable covering covered over the inflatable plastic tubes, and a controller controlled to inflate or selectively inflate the inflatable plastic tubes. Another object of the present invention is to provide an adjustable ventilation mattress which can be adjusted into any of a variety of forms for lying or sitting. Still another object of the present invention is to provide an adjustable ventilation mattress which can be automatically controlled to turn over the body of the person lying thereon. Still another object of the present invention is to provide an adjustable ventilation mattress which automatically gives off currents of air for ventilation.

DETAILED DESCRIPTION OF THE PREFERRED EMBODIMENT

Figure 1:
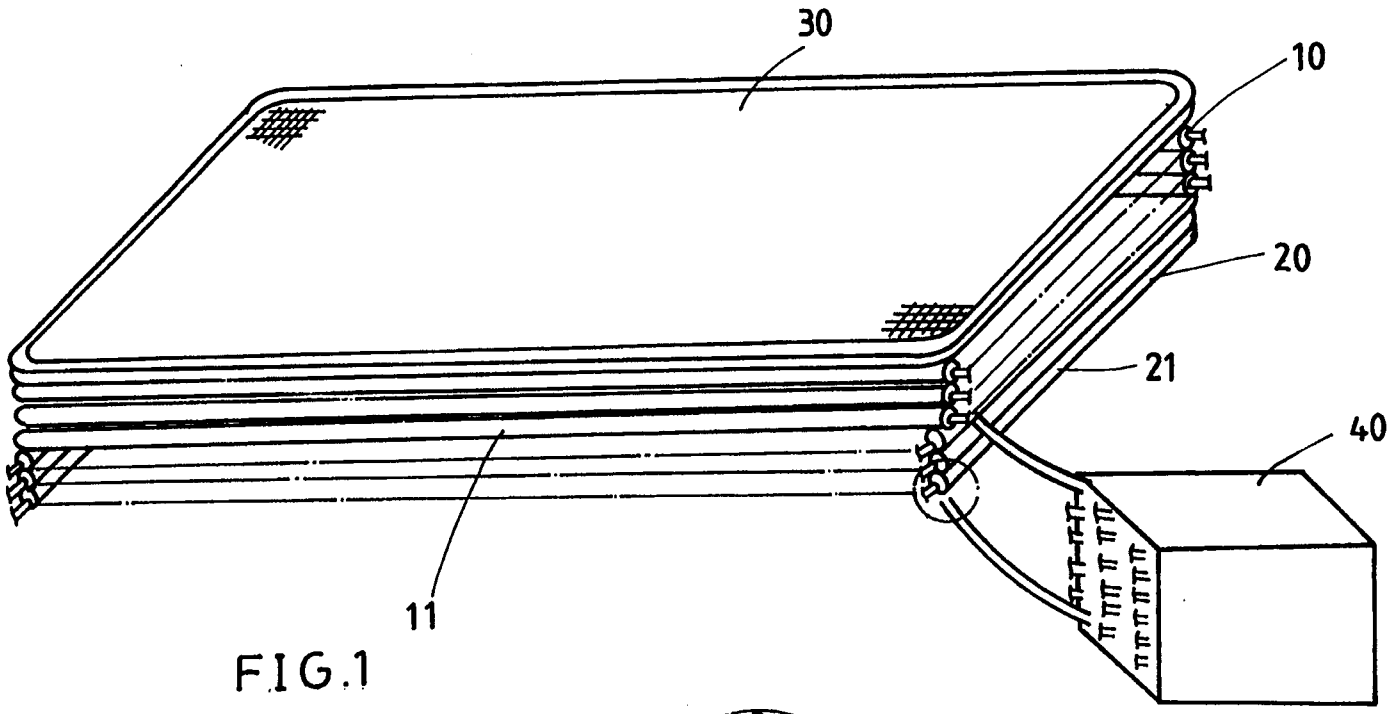
FIG. 1 is a perspective view of an adjustable ventilation mattress according to the preferred embodiment of the present invention.
Figure 1A:
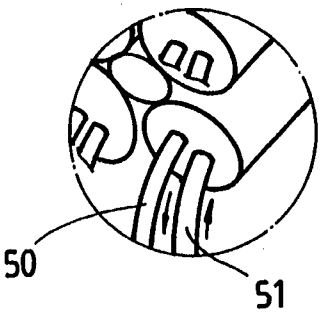
Figure 2:
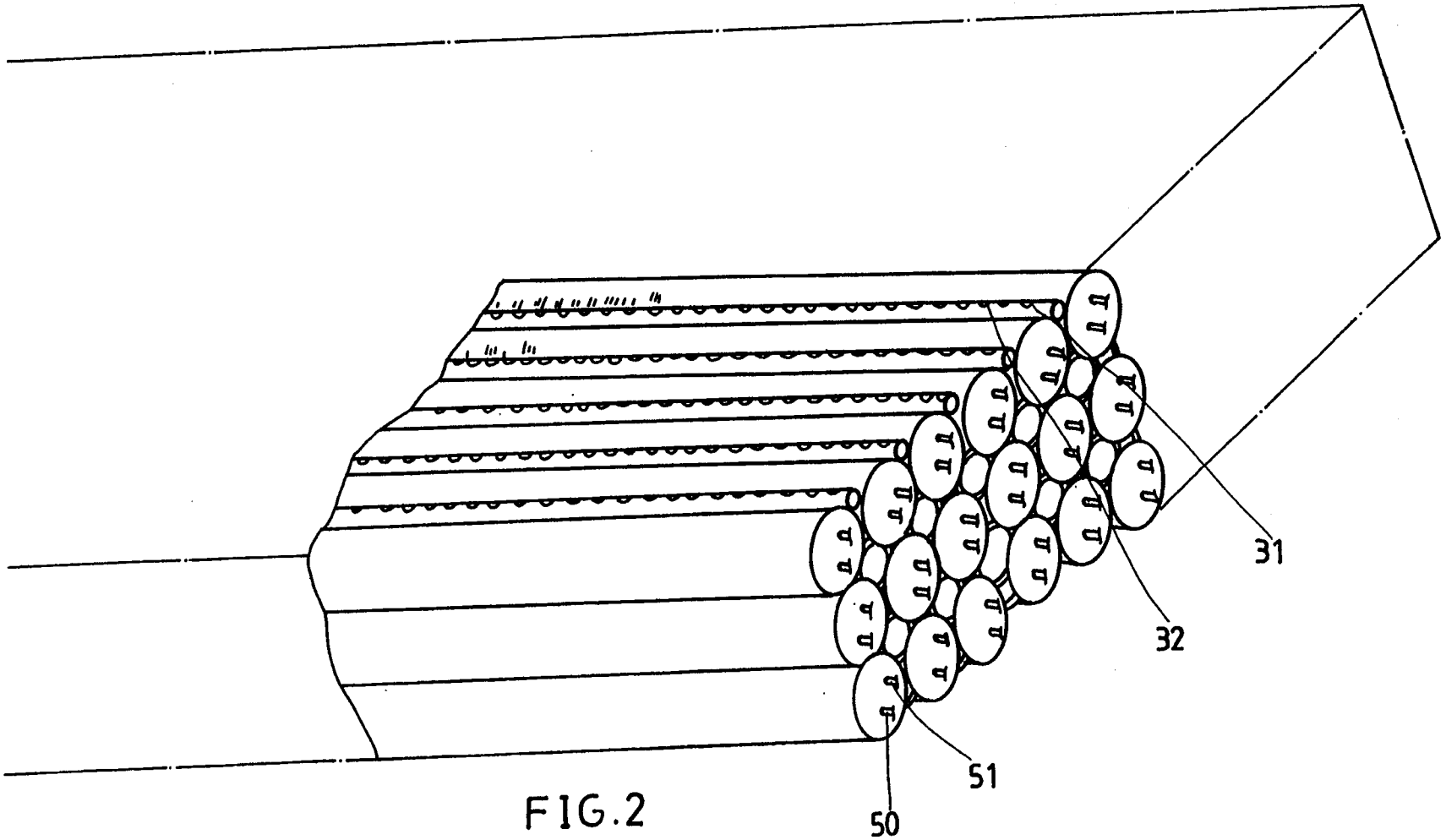
FIG. 2 is a perspective and partially cut-away view showing the arrangement of the inflatable upper filling layer of the adjustable ventilation mattress.
Figure 3:
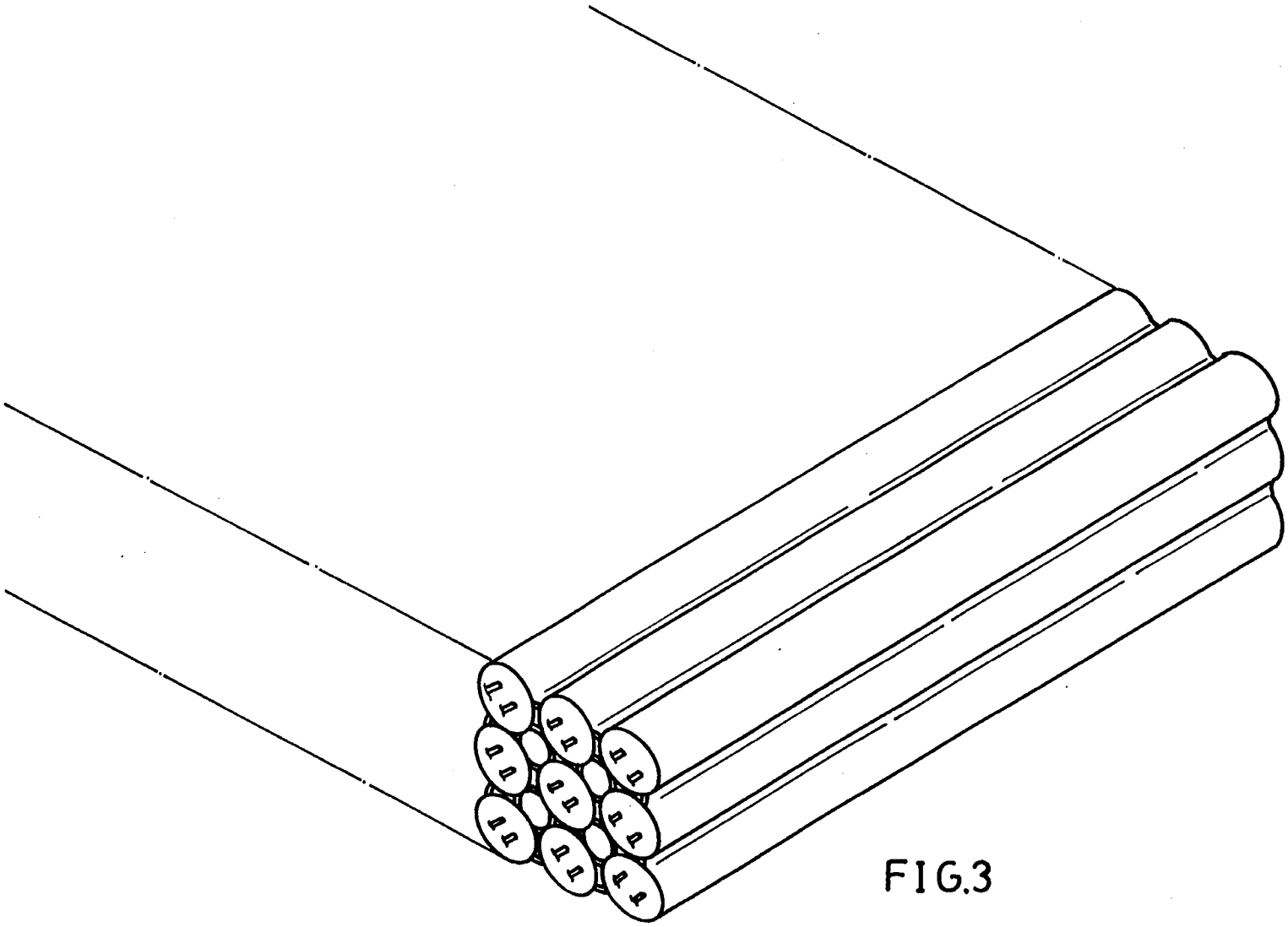
FIG. 3 is another perspective and partially cut-away view showing the arrangement of the inflatable lower filling layer of the adjustable ventilation mattress.
Figure 4A:
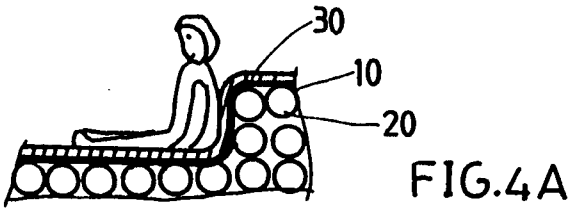
FIG. 4 illustrates various application examples according to the present invention.
Figure 4B:
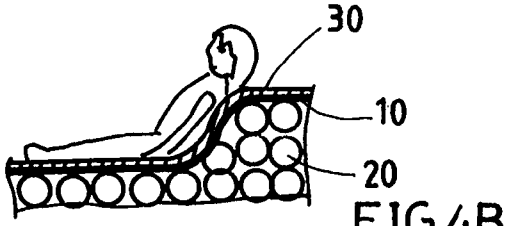
Figure 4C:
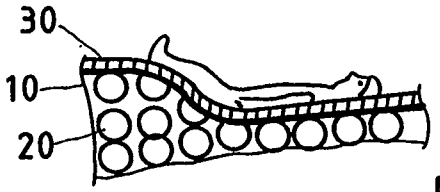
Figure 4D:
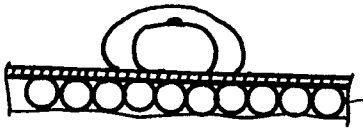
Figure 4E:
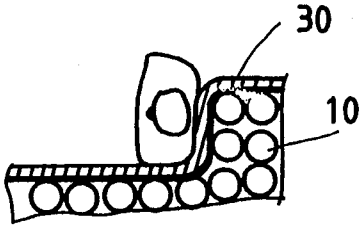
Figure 4F:
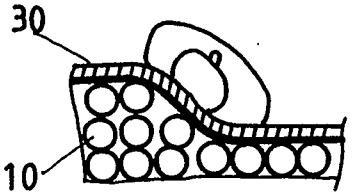
Figure 4G:
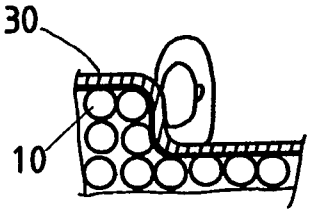

Referring to FIGS. 1, 2 and 3, an adjustable ventilation mattress as constructed according to the preferred embodiment of the present invention generally comprised of an enclosed covering layer 30 filled with an inflatable upper filling layer 10 and an inflatable lower filling layer 20, and a controller 40 controlled to inflate the inflatable upper and lower filling layers 10;20 or to draw off air therefrom. The covering layer 30 is made of a suitable air permeable material for comfortable lying of the body. The inflatable upper filling layer 10 is comprised of horizontal and vertical rows of inflatable plastic tubes closely arranged together along the length of the adjustable ventilation mattress, namely, in the longitudinal direction, each inflatable plastic tube having a respective air intake terminal 50 and a respective air outlet terminal 51 respectively connected to the controller 40. The inflatable lower filling layer 20 is comprised of horizontal and vertical rows of inflatable plastic tubes closely arranged together along the width of the adjustable ventilation mattress, namely, in the transverse direction. Similar to the inflatable upper filling layer, each inflatable plastic tube of the inflatable lower filling layer 20 also has a respective air intake terminal 50 and a respective air outlet terminal 51 respectively connected to the controller 40. Further, ventilation tubes 31 with vent holes 32 may be connected to the inflatable upper filling layer 10 between each two inflatable plastic tubes and controlled by the controller 40 to give off air for ventilation. The controller 40 is automatically controlled through a timer and an automatic control circuit to inflate the inflatable plastic tubes of the inflatable upper and lower filling layers 10;20 and to give off air through the vent holes 32 on the ventilation tubes 31 for ventilation. As the automatic control circuit is of the known art and not within the scope of the present invention, it is not described in detail. When assembled, the inflatable plastic tubes of the inflatable upper filling layer 10 are arranged above and crossed over the inflatable plastic tubes of the inflatable lower filling layer 20 and covered within the covering layer 30.

Referring to FIG. 4, by inflating the inflatable plastic tubes of the inflatable upper filling layer 10 and/or the inflatable plastic tubes of the inflatable lower filling layer 20 or selectively inflating part of the inflatable plastic tubes of the inflatable lower filling layer 20 only, the adjustable ventilation mattress is arranged into any of a variety of forms for sitting or resting the body at full length with the head or the legs lifted or with either side of the body supported on the covering layer 30 comfortably. As currents of air are continuously given off through the ventilation tubes 31, the adjustable ventilation mattress is constantly ventilated when it is in use. By controlling the amount of air being filled into the inflatable plastic tubes of the inflatable upper and lower filling layers 10;20, adjustable ventilation mattress is adjusted to the desired rigidity. Further, the present invention is most suitable for the patients who can not turn the body over on the bed. By means of setting the controller 40, the inflatable plastic tubes of the inflatable lower filling layers 20 are alternatively inflated and collapsed to change the adjustable ventilation mattress from form D to form E or from form F to form G, as shown in FIG. 4, or to change it in the reverse way, so as to turn over the body of the patient automatically.

What is claimed is:

1. An adjustable ventilation mattress comprising:

(a) an inflatable upper layer defining a plurality of inflatable upper plastic tubes in horizontal and vertical spaced relation extending in a longitudinal direction, each of said inflatable upper plastic tubes having a respective air intake terminal and a respective air outlet terminal;

(b) a plurality of ventilation tubes extending in said longitudinal direction positionally located between adjacently positioned upper plastic tubes, each of said ventilation tubes having vent holes passing through a sidewall thereof:

(c) an inflatable lower layer defining a plurality of inflatable lower plastic tubes in horizontal and vertical spaced relation extending in a transverse direction, under the entire upper layer each of said inflatable plastic tubes having a respective air intake terminal and a respective air outlet terminal;

(d) an enclosed cover layer for enclosing said inflatable upper layer, said ventilation tubes and said inflatable lower layer; and, (e) air control let means for selectively and individually inflating and deflating said upper and lower plastic tubes, said air controller means being fluidly coupled to each of said air intake and outlet terminals of each of said inflatable upper and lower plastic tubes, said air controller means being fluidly coupled to each of said ventilation tubes for passage of air therethrough.

* * * * *